US010993551B2

(12) United States Patent
Hieb et al.

(10) Patent No.: US 10,993,551 B2
(45) Date of Patent: May 4, 2021

(54) SHELVING ANGLE ADJUSTMENT MECHANISM AND RELATED METHODS

(71) Applicant: Sanden Vendo America, Inc., Dallas, TX (US)

(72) Inventors: Larry Hieb, Murphy, TX (US); Randall Meyer, Dallas, TX (US)

(73) Assignee: Sanden Vendo America, Inc., Dallas, TX (US)

( * ) Notice: Subject to any disclaimer, the term of this patent is extended or adjusted under 35 U.S.C. 154(b) by 0 days.

(21) Appl. No.: 16/163,419

(22) Filed: Oct. 17, 2018

(65) Prior Publication Data

US 2019/0110611 A1 Apr. 18, 2019

Related U.S. Application Data

(60) Provisional application No. 62/573,694, filed on Oct. 18, 2017.

(51) Int. Cl.
*A47F 3/06* (2006.01)
*A47F 5/00* (2006.01)
(Continued)

(52) U.S. Cl.
CPC ..... *A47F 3/06* (2013.01); *A47B 57/04* (2013.01); *A47F 3/004* (2013.01); *A47F 5/0043* (2013.01); *A47F 5/12* (2013.01); *A47F 2010/065* (2013.01)

(58) Field of Classification Search
CPC ..... A47B 57/04; A47F 3/06; A47F 5/0043; A47F 3/004; A47F 5/0081; A47F 5/12
See application file for complete search history.

(56) References Cited

U.S. PATENT DOCUMENTS 538,145 A * 4/1895 Allen ..... A47B 43/00 108/1
778,872 A * 1/1905 Lugosch ..... B25H 1/00 269/16
(Continued)

FOREIGN PATENT DOCUMENTS

EP 2045785 A2 4/2009
NL 1024563 C2 4/2005

OTHER PUBLICATIONS

Klinkers, Frans J., Vending machine for hot or cold food products, blocks compartment door when product inside is no longer fresh, English Abstract of Netherlands Patent Publication NL1024563, Apr. 20, 2005, European Patent Organization, http://www.epo.org/searching/free/espacenet.html.
(Continued)

*Primary Examiner* — Daniel J Rohrhoff
(74) *Attorney, Agent, or Firm* — Sierra IP Law, P.C.; Mark Miller

(57) ABSTRACT

The present invention provides shelf adjustment systems and methods that may be used in merchandiser display cases and other applications to accommodate changes in product offering, giving the user increased flexibility in the use of merchandiser display cases. The shelf adjustment systems of embodiments of the present invention provide methods and apparatus for coordinating shelf adjustment, such that adjusting the display angle of one shelf of the invention causes the display angle of another shelf or shelves to also be adjusted by the same amount as the adjusted shelf.

19 Claims, 6 Drawing Sheets

(51) Int. Cl.

| | |
|---|---|
| ***A47B 57/04*** | (2006.01) |
| ***A47F 3/00*** | (2006.01) |
| ***A47F 5/12*** | (2006.01) |
| ***A47F 10/06*** | (2006.01) |

(56) References Cited

U.S. PATENT DOCUMENTS 946,337 A * 1/1910 Clear ..... A47F 3/06 211/150
2,218,444 A * 10/1940 Vineyard ..... A47F 1/12 193/15
2,584,489 A * 2/1952 Morrison ..... A47F 5/108 211/130.1
2,648,583 A * 8/1953 Teach ..... A47F 3/06 312/136
4,044,980 A * 8/1977 Cummins ..... A47B 23/043 248/456
4,067,265 A * 1/1978 Watson ..... A47F 5/12 108/7
4,191,296 A * 3/1980 Morgan ..... A47F 1/12 211/150
4,531,646 A * 7/1985 Howard ..... A47F 5/12 108/6
4,598,828 A * 7/1986 Young ..... A47F 1/12 211/59.2
4,651,883 A * 3/1987 Gullett ..... A47F 1/12 104/140
4,685,574 A * 8/1987 Young ..... A47F 1/12 211/184
4,927,051 A 5/1990 Falk et al.
5,360,134 A 11/1994 Falk et al.
5,487,474 A * 1/1996 Heimendinger ..... A47F 1/12 211/1.57
5,590,796 A * 1/1997 Herman ..... A47F 5/108 108/99
5,730,068 A * 3/1998 Rioux, Jr. ..... A47F 5/10 108/3
5,799,822 A 9/1998 Rudewicz et al.
6,011,243 A 1/2000 Arnold et al.
6,102,162 A * 8/2000 Teicher ..... G07F 17/0042 186/39
6,105,797 A * 8/2000 Haisma ..... A47F 5/137 211/130.1
6,131,399 A 10/2000 Hall
6,321,663 B1 * 11/2001 Rogers ..... A47B 43/00 108/100
6,752,475 B2 * 6/2004 Steadman ..... A47B 51/00 312/246
6,789,392 B1 9/2004 Miller et al.
6,990,821 B2 1/2006 Singh et al.
D569,380 S * 5/2008 Beilstein ..... D14/447
8,063,735 B2 11/2011 Shoenfeld
8,544,808 B2 * 10/2013 Saad ..... A47B 91/02 108/9
9,877,436 B1 * 1/2018 Taylor ..... A01G 22/00
10,098,457 B2 * 10/2018 Gagne ..... A47B 85/06
2008/0169735 A1 * 7/2008 Yamazaki ..... A47F 3/001 312/114
2009/0277199 A1 11/2009 Manas et al.
2011/0056412 A1 * 3/2011 Grammer ..... A45C 9/00 108/6
2012/0176245 A1 7/2012 Paydar et al.
2012/0203377 A1 8/2012 Paydar et al.

OTHER PUBLICATIONS

Proposed Revisions to the NAMA Construction Standard for Unattended Location Refrigerated Display Cases used in Micro Markets, AMHIC Meeting, Apr. 26, 2013.

* cited by examiner

SHELVING ANGLE ADJUSTMENT MECHANISM AND RELATED METHODS

PRIORITY CLAIM

This is a non-provisional of and claims the benefit of U.S. Provisional Application Ser. No. 62/573,694 filed on Oct. 18, 2017, which is incorporated herein by this reference in its entirety.

FIELD OF THE INVENTION

The present invention relates to a shelf adjustment mechanism and more particularly to improved shelf angle adjustment mechanisms for food display cases, and related methods.

DISCUSSION OF THE BACKGROUND

Food merchandiser cases are a common type of equipment used by grocery stores, convenient stores, and other retail and food service providers to display foods for sale to consumers and shoppers. Some of these cases feature angled food shelves that allow for better visual presentation of the product offered, such that the consumer or shopper is presented with a more complete view of the product, even from an elevated vantage point. In other situations, it is preferable to hold products on horizontal shelves (e.g., in the case of a food product that is fluid-like and will flow within its container). To accommodate these requirements, conventional food merchandiser cases typically provide horizontal shelves, or provide shelves that are set at a predetermined inclined angle. This limits the application of equipment to a specific purpose, and may require a food seller or provider to purchase multiple merchandiser cases for various product offerings.

The conventional merchandise cases create inefficiencies for the food product retailer, since the conventional merchandiser display cases are not adjustable and require the food product retailer to tailor his food product offerings to the kinds of shelf space he has in the merchandiser cases, to place food product offerings in inappropriate or suboptimal food display shelves (e.g., on an angled shelf, when a horizontal shelf should be used), to leave shelf space unused or over-crowded do to incongruity between the food product retailers current offerings and its display case shelf space, or some ad hoc approach to maximizing use of the display case shelf space.

There is a need for improved shelving systems for merchandiser display cases.

SUMMARY OF THE INVENTION

The present invention provides shelf adjustment systems and methods are operable to be used in merchandiser display cases and other applications, and overcome many of the disadvantages and shortcomings associated with known merchandiser display constructions. The construction and operation of the shelf adjustment systems of embodiments of the present invention are operable to accommodate changes in product offering, giving the user increased flexibility in the use of merchandiser display cases.

Embodiments of the shelf adjustment systems of the present invention can be quickly and easily adjusted by the food service provider to one of a plurality of shelf angles (e.g., a horizontal position and one or more oblique angles). Some embodiments of the shelf adjustment system may include a pivoting mechanism that allows the shelf to pivot to various angles, an angle adjustment mechanism at or near the posterior portion of the shelf that allows the posterior portion of the shelf to be raised and lowered to one of a plurality of positions as the shelf pivots around the pivoting mechanism, and an angle coordination mechanism. Embodiments of the shelf adjustment system of the present invention allow adjustment of one or more shelves within a merchandiser display case or other application, thereby providing an efficient mechanism, e.g., for adjusting a display system to accommodate changes in food product offerings.

In some embodiments, the pivoting mechanism(s) of the shelf adjustment system may be located in a position located between the midpoint of each shelf and the anterior end of each shelf included in the system. In some embodiments, the pivoting mechanism may be located at or near the anterior end of the shelf in order to minimize the vertical displacement of the anterior end of each shelf when angled at a downward sloping angle. The anterior end of the shelf may refer, e.g., to the end of the shelf that is adjacent to the customer-facing display window of a merchandiser display case. Thus, raising of the posterior end of each shelf will angle each shelf downward toward the customer-facing display window. The pivoting mechanism may be an axle running through a channel running through the anterior portion of a shelf and rotatably engaging with the frame of the display case, such as support beams or other support structures positioned adjacent to the shelf(ves). In other embodiments, the anterior pivoting mechanism may be pegs, pins, or other protrusions that can be nested in a receiver in a support beam or other support structure that allows pivoting rotation of the shelf(ves). The pegs, pins or other protrusions may be embedded in the lateral sides of the shelf(ves) or may be attached to a surface of the shelf(ves) with brackets or other connecting means.

The angle adjustment mechanism allows the shelf(ves) to be angled at one or more positions to adjust presentation of the items of on the shelf(ves). The angle adjustment may be embodied in various mechanisms that allow the angle of the shelf(ves) to be adjusted. In one embodiment and without limitation, the angle adjustment mechanism is a pivoting foldable support that can be folded under the shelf when the shelf(ves) is in a lowered position, and which may be extended to prop up the shelf(ves) when the shelf(ves) are in a raised position. For example, an angle adjustment mechanism may be a pivoting support member such as a plate, rod, wireframe, or other structure that is sufficiently rigid and strong to hold the weight of the shelf(ves) and the products positioned thereon. The pivoting support mechanism may be folded under, to the rear, or to the side of the shelf(ves) when the shelf(ves) are in a lowered (e.g., substantially horizontal) position. The pivoting support member may have a thickness that is sufficiently small to allow the pivoting support member to be folded under the shelf(ves) such that the shelf(ves) (e.g., the base shelf) can be laid substantially horizontally on an underlying support (e.g., the internal floor of a merchandiser unit). In some examples, the base shelf may include a recess on the bottom side thereof to allow the pivoting support member to nest beneath the base shelf when the shelf(ves) are in a lowered position.

The angle adjustment mechanism allows the shelf(ves) to be angled at one or more positions to adjust presentation of the items of on the shelf(ves). The angle adjustment may be embodied in various mechanisms that allow the angle of the shelf(ves) to be adjusted. In one embodiment and without limitation, the angle adjustment mechanism is a pivoting foldable support that can be folded under the shelf when the shelf(ves) is in a lowered position, and which may be extended to prop up the shelf(ves) when the shelf(ves) are in a raised position. For example, an angle adjustment mechanism may be a pivoting support member such as a plate, rod, wireframe, or other structure that is sufficiently rigid and strong to hold the weight of the shelf(ves) and the products positioned thereon. The pivoting support mechanism may be folded under, to the rear, or to the side of the shelf(ves) when the shelf(ves) are in a lowered (e.g., substantially horizontal) position. The pivoting support member may have a thickness that is sufficiently small to allow the pivoting support member to be folded under the shelf(ves) such that the shelf(ves) (e.g., the base shelf) can be laid substantially horizontally on an underlying support (e.g., the internal floor of a merchandiser unit). In some examples, the base shelf may include a recess 28 on the bottom side thereof to allow the pivoting support member to nest beneath the base shelf when the shelf(ves) are in a lowered position.

The shelf angle coordination mechanism may hold two or more shelves at a constant relative angle to one another. For example, if the shelf adjustment system includes two shelves (e.g., a base shelf and a second shelf located a distance above the base shelf), the shelf angle coordination mechanism may maintain the relative angle between the base shelf and the second shelf as the angle adjustment mechanism is used to adjust the slope of the shelves. If the shelves are in parallel (a relative angle of 180°), the angle coordination mechanism may be used to maintain the parallel arrangement of the shelves as their angles change relative to the horizontal. For example and without limitation, the operation of the angle adjustment mechanism to change the angle of the base shelf from about 0° to about 15° relative to the horizontal may be translated to the second shelf by the angle coordination mechanism, such that the angle of the second shelf is simultaneously also changed from about 0° to about 15° relative to the horizontal. It is to be appreciated that in embodiments of the invention without any angle coordination mechanism, changing the angle of one shelf of the system will not change the angle of the other shelf(ves) in the system.

The shelf angle coordination system may include position maintenance members that hold the relative positions of the shelves constant. For example, in some embodiments, the position maintenance members may be one or more rods that connect corresponding positions between the shelves (e.g., rods running from back corners of a base shelf to the back corners of a second shelf). The rods may be connected or engaged with the surface of the shelves in such a way that the rods pivot as the base shelf is raised and lowered. In other examples, the shelf angle coordination system may include a plate connecting the base shelf and the second shelf thereover, where the plate is connected to each shelf by a hinge joint, allowing the plate to pivot and maintain the relative angle of the base shelf and the second shelf as the base shelf is lifted. In further embodiments in which the angle adjustment mechanism is motorized and is on a track, the pegs may be spaced apart on the chain in combination with the tracks on the base and second shelves that allow the pegs to slide along the depth of their corresponding shelf, and may in combination function as the angle coordination mechanism, holding the base and second shelves at a constant relevant angle.

It is to be understood that there are variations of the shelf angle adjustment system that are within the scope of the present invention, even if not presented as part of the exemplary embodiments of the present invention. For example, the shelves of the display case may have non-parallel arrangements, and the shelf angle adjustment system may be operable to maintain the shelves in their non-parallel relative angles as the positions shelves are adjusted. As a further example, the shelf angle adjustment mechanism may be incorporated into other apparatus, such as vending machines. Descriptions of embodiments of the invention follow, which are meant to illustrate the invention.

In one aspect, the invention is relates to a shelf adjustment system, comprising a plurality of shelves; an angle coordination mechanism positioned between the plurality of shelves for maintaining the relative angle or angles between the plurality of shelves; and an angle adjustment mechanism for changing the angle of each of the plurality of shelves in a coordinated manner. The shelf adjustment mechanism may further include a pivoting mechanism, the pivoting mechanism rotatably connecting each of the plurality of shelves to a support structure. The shelf adjustment system may be incorporated into a food display case. The plurality of shelves may be maintained in parallel by the angle coordination system to provide a consistent display of products in the display case. The angle coordination mechanism may comprise a rod positioned between rear portions of the plurality of shelves to fix the plurality of shelves in their positions relative to each other. The angle adjustment mechanism may include a pivoting rod or plate that is stowed when the plurality of shelves is in a lowered position and is raised and engaged with a rear portion of a lower-most shelf when the shelves are in a raised position. The angle adjustment mechanism may include a motorized vertical actuation device engaged with each of the plurality of shelves such that each of the plurality of shelves is raised or lowered by the same distance as the vertical actuation device moves. The plurality of shelves may have individually varying angles relative to the horizontal, but are maintained in their relative orientation by the angle coordination mechanism. The pivoting mechanism may be on a portion of the shelf positioned at or near an opposite end of the shelf from the angle adjustment mechanism. The pivoting mechanism may be on a portion of the shelf positioned at or near the angle adjustment mechanism.

In another aspect, the present invention relates to a merchandising display case, comprising a plurality of shelves; a pivoting mechanism rotatably connecting each of the plurality of shelves to a support structure; an angle coordination mechanism positioned between the plurality of shelves for maintaining the relative angle or angles between the plurality of shelves; and an angle adjustment mechanism for changing the angle of each of the plurality of shelves in a coordinated manner. The plurality of shelves may be maintained in parallel by the angle coordination system to provide a consistent display of products in the display case. The angle coordination mechanism may comprise rod positioned between rear portions of the plurality of shelves to fix the plurality of shelves in their positions relative to each other. The angle adjustment mechanism may include a pivoting rod or plate that stowed when the plurality of shelves are in a lowered position and is raised and engaged with a rear portion of a lower-most shelf when the shelves are in a raised position. The angle adjustment mechanism may include motorized vertical actuation device engaged with each of the plurality of shelves such that each of the plurality of shelves is raised or lowered by the same distance as the vertical actuation device moves. The plurality of shelves may have individually varying angles relative to the horizontal, but are maintained in their relative orientation by the angle coordination mechanism. The pivoting mechanism may be on a portion of the shelf positioned at or near an opposite end of the shelf from the angle adjustment mechanism. The pivoting mechanism may be on a portion of the shelf positioned at or near the angle adjustment mechanism.

In another aspect, the present invention relates to a method of adjusting the angle of a plurality of shelves in an apparatus, comprising raising the plurality of shelves simultaneously such that the relative angles of the shelves are maintained, the apparatus comprises the plurality of shelves; a pivoting mechanism rotatably connecting each of the plurality of shelves to a support structure; an angle coordination mechanism positioned between the plurality of shelves for maintaining the relative angle or angles between the plurality of shelves; and an angle adjustment mechanism for changing the angle of each of the plurality of shelves in a coordinated manner. The plurality of shelves may be maintained in parallel by the angle coordination system to provide a consistent display of products in the display case. The angle coordination mechanism may comprise a rod positioned between rear portions of the plurality of shelves to fix the plurality of shelves in their positions relative to each other. The angle adjustment mechanism may include a pivoting rod or plate that is stowed when the plurality of shelves is in a lowered position and is raised and engaged with a rear portion of a lower-most shelf when the shelves are in a raised position. The angle adjustment mechanism may include motorized vertical actuation device engaged with each of the plurality of shelves such that each of the plurality of shelves is raised or lowered by the same distance as the vertical actuation device moves. The plurality of shelves may have individually varying angles relative to the horizontal, but are maintained in their relative orientation by the angle coordination mechanism. The pivoting mechanism may be on a portion of the shelf positioned at or near an opposite end of the shelf from the angle adjustment mechanism. The pivoting mechanism may be on a portion of the shelf positioned at or near the angle adjustment mechanism.

In another aspect, the invention relates to an adjustable shelf system that may include shelves with a pivotably front mounting mechanism and an adjustable rear shelf support for adjusting the angle of the shelf. The system may include two or more shelves connected to an adjustment mechanism, such that the relative angle of the shelves is maintained (e.g., the shelves may remain parallel). In one embodiment, and without limitation, a set of connecting rods are provided to link an upper shelf to a lower shelf such that as one shelf is pivoted to change the angle thereof, the other shelf is pivoted in the same manner by the same change in angle of the shelf. As one shelf is raised, or lowered, the connected shelf follows the other, to maintain the relative angle of the shelf (e.g., maintain the shelves in parallel). The shelf adjustment mechanism may include a shelf support that is operable to (1) support the one or more shelves in a raised position in which the rear portions of the shelves are tilted up, and (2) is pivotably mounted or collapsible so that it can be stowed when the one or more shelves are in a lowered or horizontal position.

It is therefore an object of the present invention to provide methods and apparatus for adjusting the angles of one or more shelves in a merchandise display.

It is also an object of the present invention to provide methods and apparatus for coordinating the adjustment of the angles of two or more shelves in a merchandise display such that adjustment of one of the shelves causes the same adjustment in another shelf(ves) in the display.

It is also an object of the present invention to provide methods and apparatus for coordinating the adjustment of the angles of all shelves in a merchandise display such that adjustment of one of the shelves causes the same adjustment in all other shelves in the display.

Additional aspects and objects of the invention will be apparent from the detailed descriptions and the claims herein.

The present invention provides shelf adjustment systems and methods are operable to be used in merchandiser display cases and other applications, and overcome many of the disadvantages and shortcomings associated with known merchandiser display constructions. The construction and operation of the shelf adjustment systems of embodiments of the present invention are operable to accommodate changes in product offering, giving the user increased flexibility in the use of merchandiser display cases.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without these specific details.

FIGS. 1-5 provide views of an exemplary embodiment of a shelf adjustment system of the present invention, wherein a merchandiser display case is shown with the shelf adjustment system implemented therein. It is to be understood that the shelf adjustment system can be implemented in other apparatus.

Figure 1:
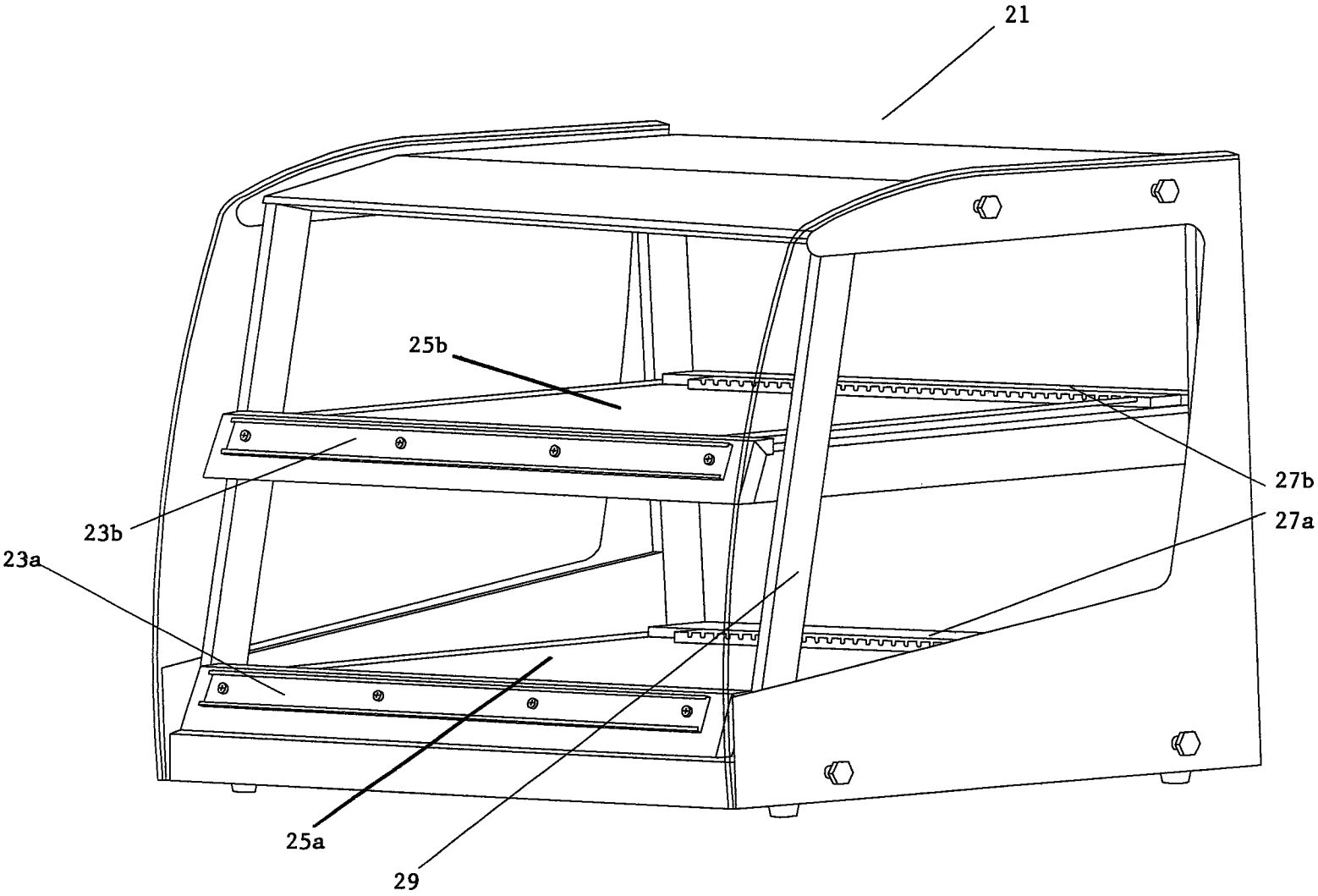
FIG. 1 is a front perspective view of a merchandiser display case incorporating an embodiment of the shelf adjustment system of the present invention.

FIG. 1 provides a front perspective view of an exemplary merchandiser display case 21 having an opening through which food items may be displayed on the shelves therein. The shelves may have slots therein to maintain food products in organized columns on the shelf. The anterior ends 23 of the shelves 25*a*, 25*b* can be seen near the display window. The pivoting mechanisms 29 for each of the shelves may be located in a position near the anterior ends of the shelves. The positioning of the pivoting mechanisms near the anterior ends of the shelves minimizes the vertical displacement of the shelves when the angle of the shelves is adjusted by the user. The pivoting mechanism may be a peg or axle that rotatably connects the anterior end of the shelf to the interior frame or sidewall of the display case.

Figure 2:
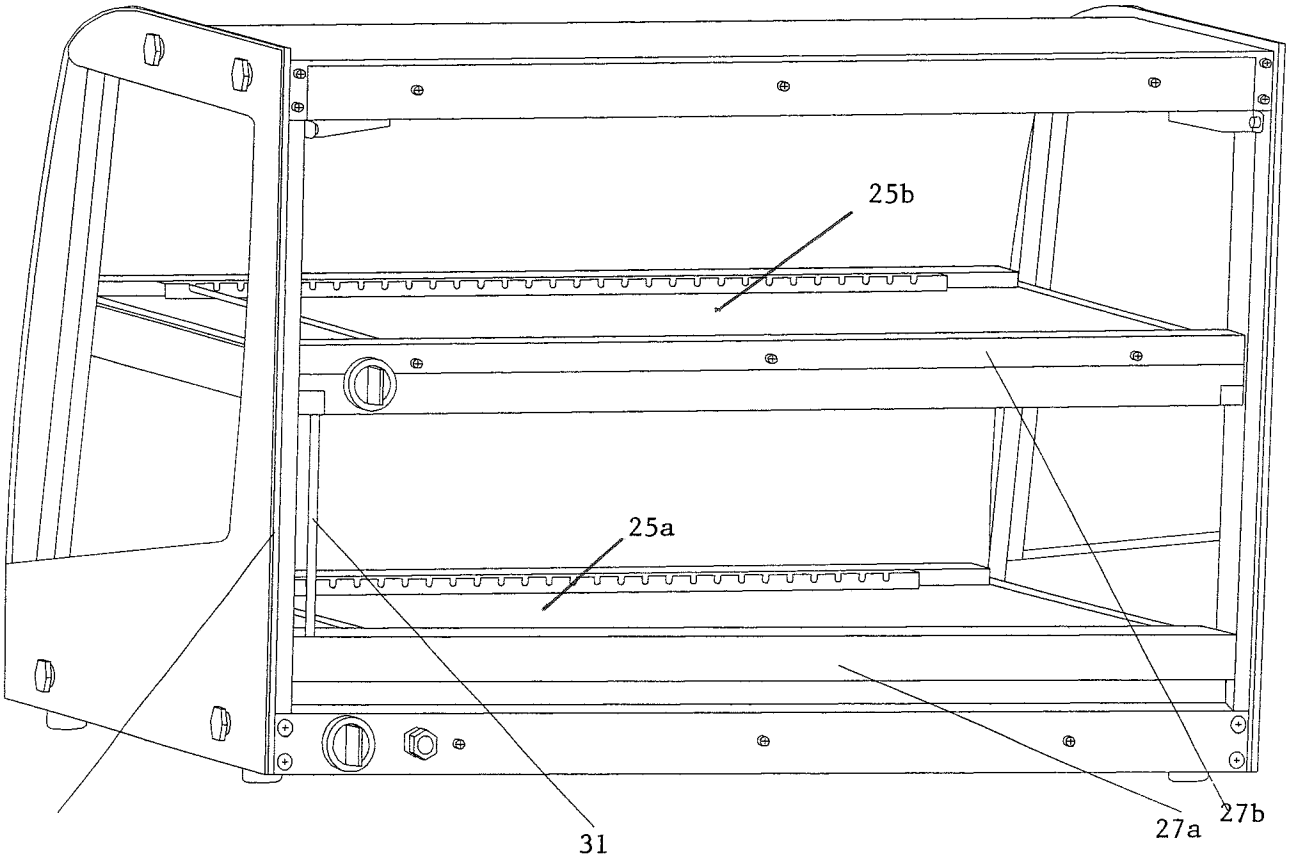
FIG. 2 is a rear perspective view of a merchandiser display case incorporating an embodiment of the shelf adjustment system of the present invention.

FIG. 2 provides a posterior view of the exemplary display case 21. The display case may include an open backside with temperature controls for maintaining a substantially constant preferred temperature within the display case. The posterior portions 27*a*, 27*b* of the shelves 25*a*, 25*b* is also shown. The angle coordination mechanism in this embodiment, the angle coordination rod 31, is visible on the left side of the rear view of the display case. The angle coordination rod 31 connects the rear corner of the base shelf 25*a* and the rear corner of the upper second shelf 25*b* in a spaced vertical relationship that maintains the relative angle of the two shelves 25*a*, 25*b* when the base shelf 25*a* is raised to present food products placed on the shelf at a downward sloping angle.

Figure 3:
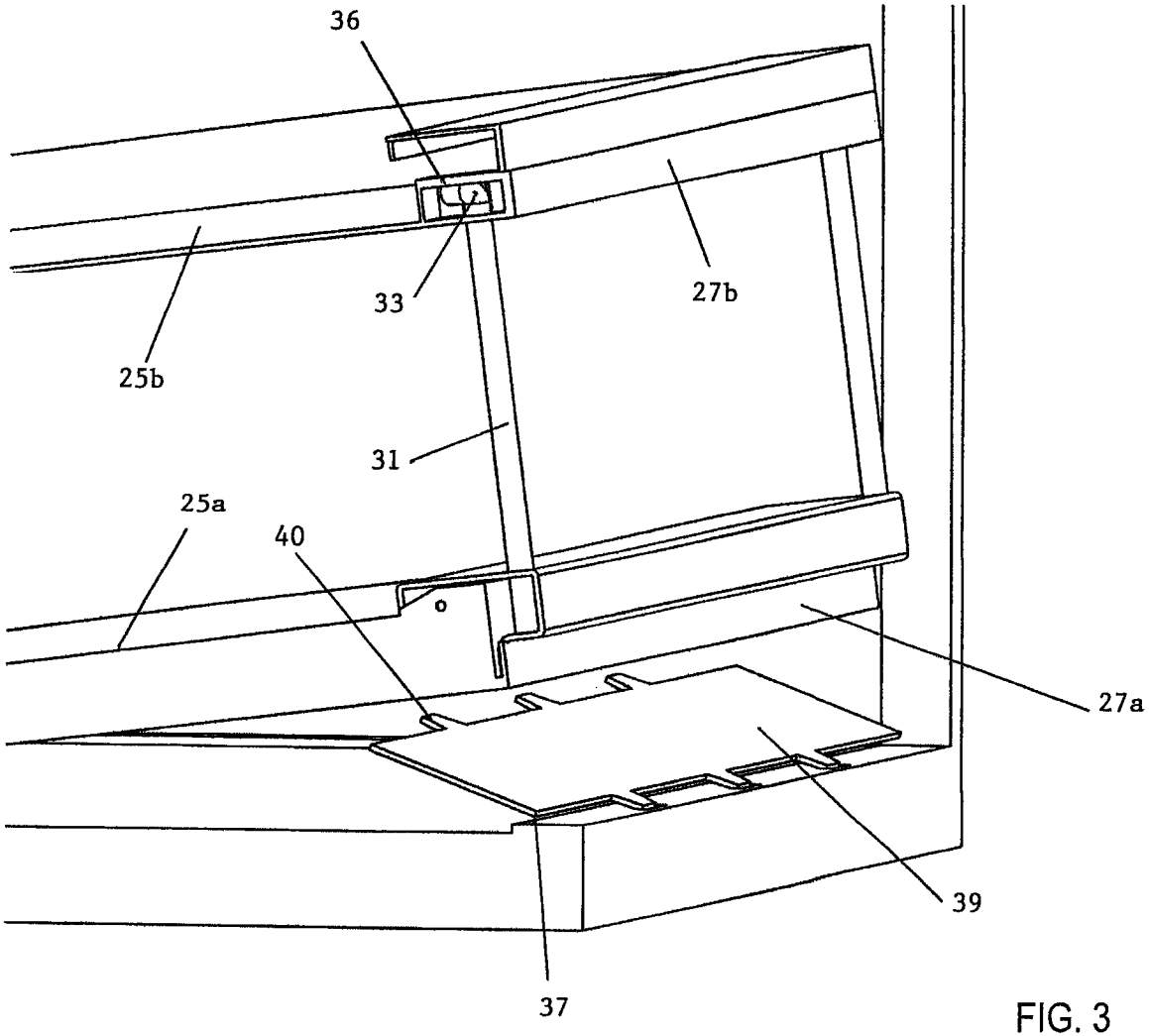
FIG. 3 is a close up rear perspective sectional view showing an embodiment of an angle adjustment mechanism in a partially raised state before engagement with a shelf of an embodiment of the invention.
Figure 3A:
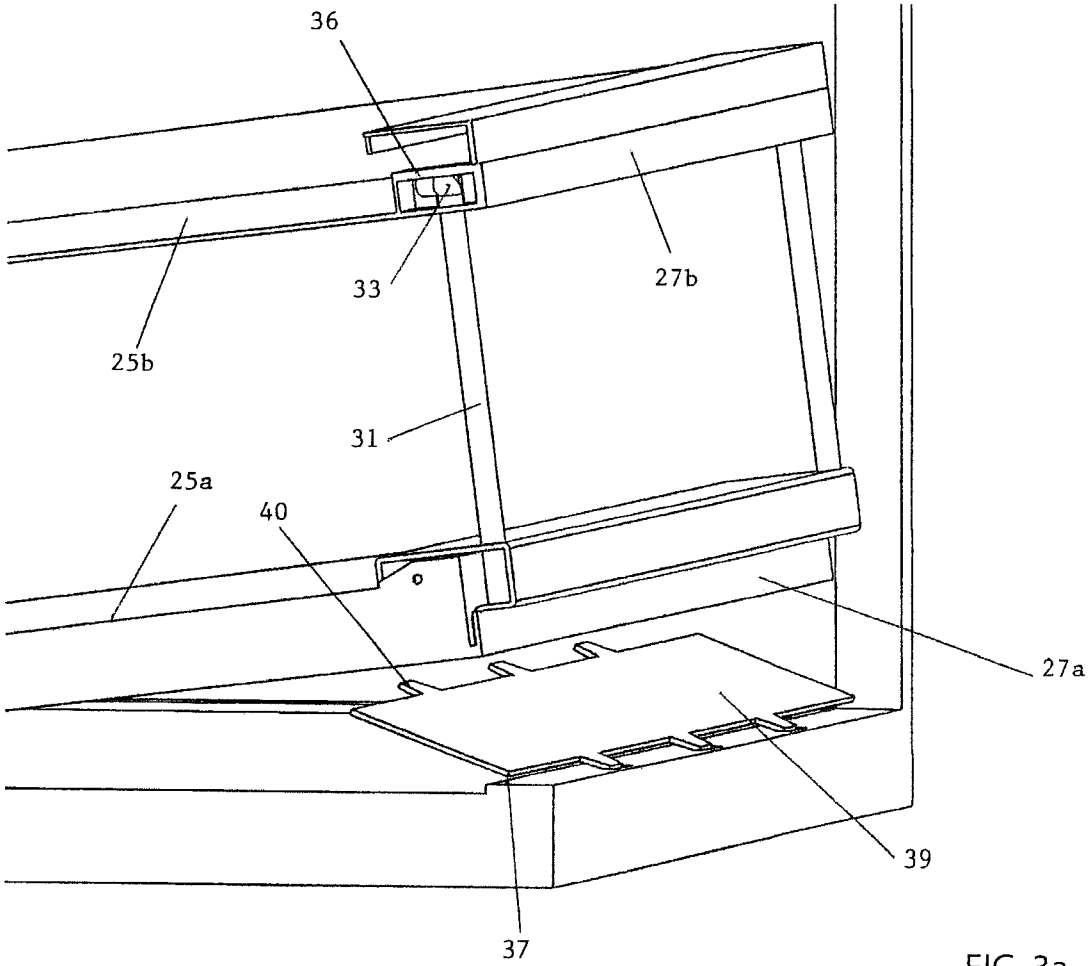
FIG. 3*a* is a close up rear perspective sectional view showing an alternative embodiment of an angle adjustment mechanism in a partially raised state before engagement with a shelf of an embodiment of the invention.

FIG. 3 provides a close-up view of an embodiment of a rear corner of a display case in which the rear portion of the base shelf 25*a* is shown in a partially raised position, with the angle adjustment mechanism 39 partially pivoted up before engagement with the underside of the rear portion 27*a* of shelf 25*a*. In this embodiment, the angle adjustment mechanism is a pivoting plate 39 attached to rear base of the display case by a pivoting joint 37 that allows the pivoting plate 39 to swing up to engage with a rear portion 27*a* of the base shelf 25*a* thereby raising the rear portion of the base shelf and placing the base shelf at a downward slope. The pivoting plate 39 may include pegs or other protrusions 40 for engagement with corresponding recesses or receivers on the rear portion 27*a* of the base shelf 25*a*, such that the engagement provides a stable connection between the pivoting plate 39 and the rear portion of the base shelf that prevents the plate 39 from slipping out of position once engaged with the rear portion of the base shelf. The base shelf 25*a* may be lifted manually by the user and the pivoting plate 39 may then be manually positioned for engagement with the rear portion of the base shelf.

Figure 4:
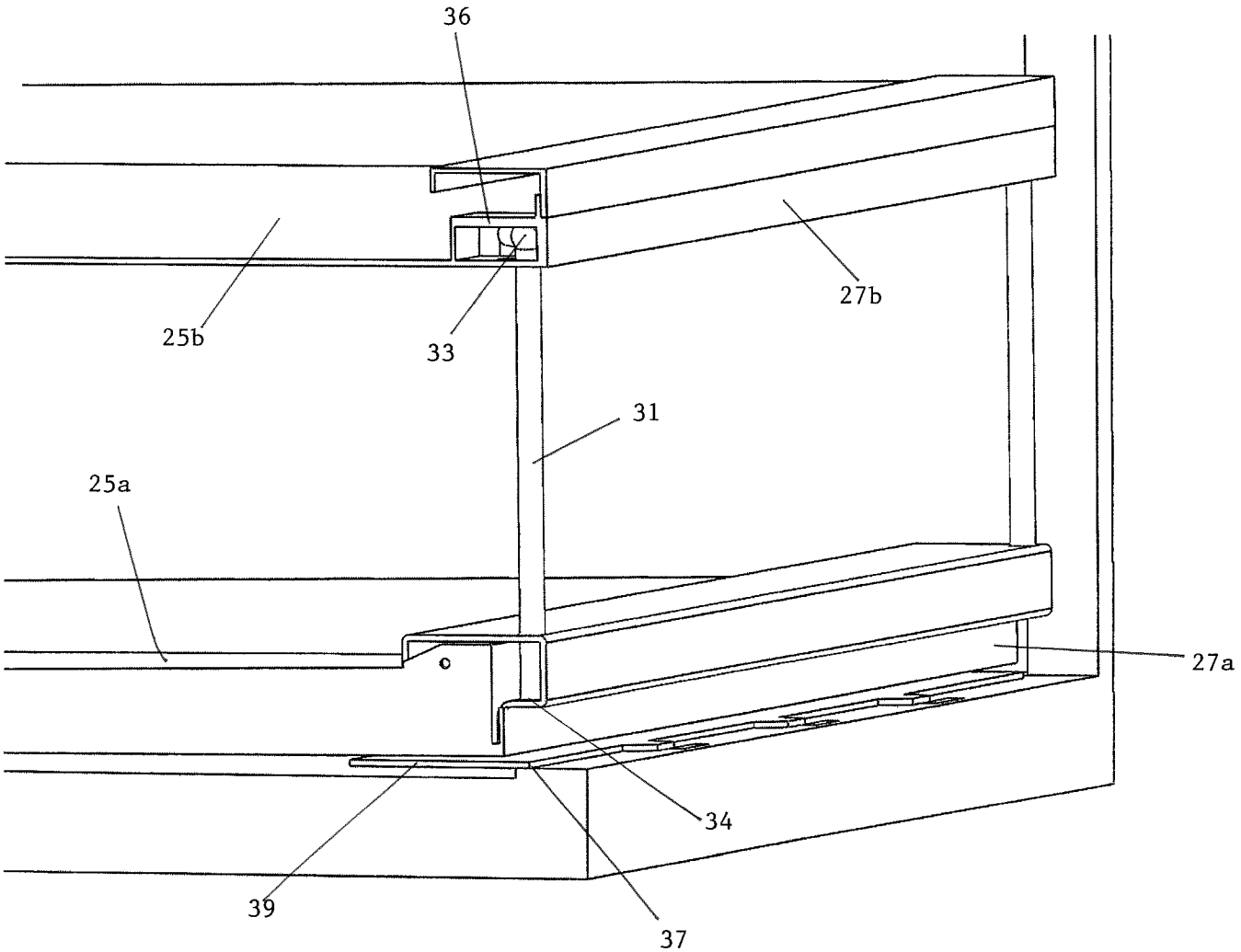
FIG. 4 is a close up rear perspective sectional view of an embodiment of the present invention showing the illustrated shelves in a lowered position.

FIG. 4 shows a close-up view of an embodiment of an angle coordination rod 31 and its engagement with a base shelf 25*a* and second shelves 25*b* within the exemplary display case with the sidewall and frame of the display case removed for an unobstructed view of the angle coordination mechanism and the angle adjustment mechanism. FIG. 4 provides a view of the system with the shelves in a lowered position in which both shelves 25*a*, 25*b* are substantially horizontal, with the second shelf 25*b* propped in a substantially horizontal position by the angle coordination rod 31. In the lowered position, the angle adjustment plate (pivoting plate) 39 is stowed below the base shelf. The angle coordination rod 31 may be supported within the structure of the base shelf 25*a* on a platform 34, as shown in FIG. 4, on which it may pivot as the base shelf is raised and lowered. In other embodiments, the rod may have a pivoting joint that connects the lower end of the rod to the base shelf. The superior end of the coordination rod 31 may have a flattened end or horizontal extension 33 to provide a support surface for engagement with a slot or flat support surface 36 at the posterior portion 27*b* of the second shelf 25*b*, as shown in FIG. 4. In other embodiments, the superior end of the rod 31 may have a pivoting joint that connects the lower end of the rod to the base shelf. It is to be appreciated that in some embodiments, a plurality of angle coordination rods 31 may be employed for additional stability and support of the upper shelf(ves).

Figure 5:
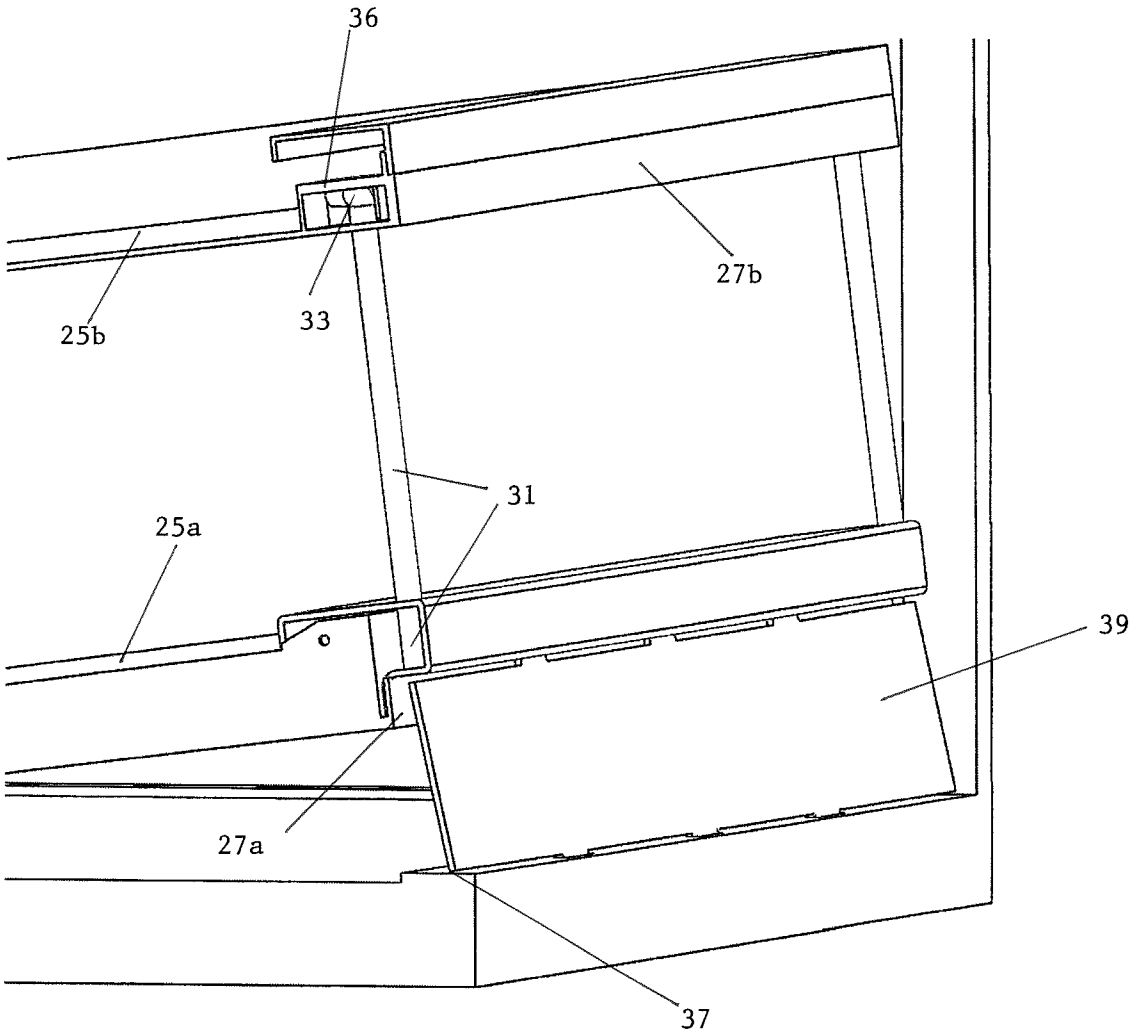
FIG. 5 is a close up rear perspective sectional view of an embodiment of the present invention showing the illustrated shelves in a raised position.

FIG. 5 also shows a close up view of an embodiment of an angle coordination rod 31 and its engagement with the base and second shelves within the exemplary display case with the sidewall and frame of the display case removed for an unobstructed view of the angle coordination mechanism and the angle adjustment mechanism. FIG. 5 provides a view of the system with the shelves 25*a*, 25*b* in a raised position in which both shelves are at an oblique angle with respect to the horizontal, such that the shelves slope downward from the rear portions 27*a*, 27*b* of the shelves to the anterior portions (23*a*, 23*b*) of the shelves, with the second shelf 25*b* propped by the angle coordination rod 31. In this embodiment, the angle coordination rod 31 is operable to maintain the relative angle of the base and second shelves as they are raised (and lowered) such that the shelves remain in a parallel orientation relationship to each other. The angle adjustment plate (pivoting plate) 39 is raised in FIG. 5 to a substantially vertical position and is engaged with the rear portion 27*a* of the base shelf to prop the base shelf at the oblique angle. The angle coordination rod 31 pivots on its engagements with the base shelf 25*a* and the second shelf 25*b* as the base shelf 25*a* is raised.

The present invention provides shelf angle adjustment system and apparatus that include the same. It is to be understood that here are several variations in the shelf angle adjustment system that provide additional benefits, as disclosed above. For example and without limitation, embodiments of the invention may include a pivoting plate for adjustment of the angle of a lower shelf, but without any coordination rods such that adjustment of the angle of the lower shelf does not change the angle of any other shelf (ves).

It should also be understood that the foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A merchandising display case and shelf adjustment system, comprising:

a. a plurality of adjustable shelves;

b. an angle adjustment mechanism for changing the display angle of a first shelf of said plurality of shelves comprising a plate member pivotally attached to a base at a rear of said display case underneath said first shelf for engagement with an underside of said first shelf such that said plate member is capable of being accessed from the rear and being easily manually moved between a first position where said plate member is stowed underneath said first shelf and a second position where said plate member raises a rear portion of said first shelf;

c. an angle coordination mechanism positioned between said first shelf and at least one other shelf of said plurality of shelves for changing the display angle of said at least one other shelf when the display angle of said first shelf is changed.

2. The system of claim 1, wherein said plurality of shelves are maintained in parallel by the angle coordination mechanism to provide a consistent display of products in the merchandising display case.

3. The system of claim 1, wherein said angle coordination mechanism comprises at least one rod positioned between rear portions of said plurality of shelves to fix said plurality of shelves in their positions relative to each other.

4. The system claim 1, wherein a recess is provided on a bottom side of said first shelf for receiving said angle adjustment mechanism when stowed.

5. The display case of claim 1 wherein said angle coordination mechanism comprises at least one rod positioned between a rear portion of said first shelf and a rear portion of said at least one other shelf and wherein said rod includes an extension at one end for engagement with said other shelf.

6. A merchandising display case, comprising:

a. a plurality of adjustable shelves;

b. a pivoting mechanism provided on each shelf of said plurality of shelves for pivotally mounting front ends of each shelf to a support frame;

c. an angle adjustment mechanism for changing the display angle of a first shelf of said plurality of shelves comprising a plate member pivotally attached to a base at a rear of said display case underneath said first shelf for engagement with an underside of said first shelf such that said plate member is capable of being accessed from the rear and being easily manually moved between a first position where said plate member is stowed underneath said first shelf and a second position where said plate member raises a rear portion of said first shelf; and d. an angle coordination mechanism positioned between said first shelf and at least one other shelf of said plurality of shelves for changing the display angle of said at least one other shelf when the display angle of said first shelf is changed.

7. The display case of claim 6, wherein said plurality of shelves are maintained in parallel by the angle coordination mechanism to provide a consistent display of products in the merchandising display case.

8. The display case of claim 6, wherein said angle coordination mechanism comprises at least one rod positioned between rear portions of said plurality of shelves to fix said plurality of shelves in their positions relative to each other.

9. The display case of claim 6, wherein a recess is provided on a bottom side of said first shelf for receiving said angle adjustment mechanism when stowed.

10. The display case of claim 6 wherein said angle coordination mechanism comprises at least one rod positioned between a rear portion of said first shelf and a rear portion of said at least one other shelf and wherein said rod includes an extension at one end for engagement with said other shelf.

11. A method of adjusting the angles of a plurality of shelves in a display case comprising the steps of:

a. pivotally attaching each shelf of said plurality of shelves to a support structure;

b. providing an angle adjustment mechanism at a posterior portion of a designated one of said plurality of shelves for changing the display angle of said designated shelf comprising a plate member pivotally attached to a base at a rear of said display case underneath said designated shelf for engagement with an underside of said designated shelf such that said plate member is capable of being accessed from the rear and being easily manually moved between a first position where said plate member is stowed underneath said designated shelf and a second position where said plate member raises said posterior portion of said designated shelf;

c. providing an angle coordination mechanism between each shelf of said plurality of shelves for maintaining the display angles between the shelves; and d. changing the display angle of all shelves of said plurality of shelves by accessing the rear of said display case and changing the display angle of the designated shelf using said angle adjustment mechanism.

12. The method of claim 11, wherein said plurality of shelves are maintained in parallel by the angle coordination mechanism to provide a consistent display of products in the display case.

13. The method of claim 11, wherein said angle coordination mechanism comprises at least one rod positioned between posterior portions of said plurality of shelves to fix said plurality of shelves in their positions relative to each other.

14. The method of claim 13 wherein each rod further comprises an extension at one end for engagement with one of said plurality of shelves.

15. The method of claim 11, wherein a recess is provided on a bottom side of said designated shelf for receiving said angle adjustment mechanism when stowed.

16. A merchandising display case, comprising:

a. a plurality of adjustable shelves;

b. a pivoting mechanism provided on each shelf of said plurality of shelves for pivotally mounting each shelf to a support structure;

c. an angle adjustment mechanism for changing the display angle of a bottom most shelf of said plurality of shelves comprising a plate member pivotally attached to a base at a rear of said display case underneath said bottom most shelf for engagement with an underside of said bottom most shelf such that said plate member is capable of being accessed from the rear and being easily manually moved between a first position where said plate member is stowed underneath said bottom most shelf and a second position where said plate member raises a rear portion of said bottom most shelf; and d. an angle coordination mechanism positioned between each shelf of said plurality of shelves for changing the display angle of all shelves when the display angle of said bottom most shelf is changed.

17. The display case of claim 16, wherein said angle coordination mechanism comprises at least one rod positioned between rear portions of each of said plurality of shelves to fix said plurality of shelves in their positions relative to each other.

18. The display case of claim 17 wherein each rod further comprises an extension at one end for engagement with one of said plurality of shelves adjacent to said bottom most shelf.

19. The display case claim 16, wherein a recess is provided on a bottom side of said bottom most shelf for receiving said angle adjustment mechanism when stowed.

* * * * *